US006109446A

United States Patent [19]

Foote

[11] Patent Number: 6,109,446

[45] Date of Patent: Aug. 29, 2000

[54] COLLAPSIBLE CURLING IRON ORGANIZER

[76] Inventor: Antoinette Foote, 7443 Ahern, St. Louis, Mo. 63130

[21] Appl. No.: 09/414,739

[22] Filed: Oct. 8, 1999

[51] Int. Cl.[7] ..... B65D 5/50

[52] U.S. Cl. ..... 206/759; 206/372; 219/242

[58] Field of Search ..... 206/756, 759, 206/761, 762, 763, 764, 765, 446, 486, 443, 581, 372, 373, 349; 219/222, 225, 242; 132/133

[56] References Cited

U.S. PATENT DOCUMENTS

| | | | |
|---|---|---|---|
| 1,519,614 | 12/1924 | Heck . | |
| 2,408,227 | 9/1946 | Ramsey . | |
| 2,567,564 | 9/1951 | Ingraham | 206/759 |
| 3,564,662 | 2/1971 | Dold . | |
| 4,103,145 | 7/1978 | Oliveri . | |
| 4,211,455 | 7/1980 | Tedrow . | |
| 4,446,972 | 5/1984 | Sussman . | |
| 4,819,800 | 4/1989 | Wilson . | |
| 5,054,615 | 10/1991 | Stillwagon et al. | 206/373 |
| 5,203,456 | 4/1993 | Boswell | 206/349 |
| 5,586,653 | 12/1996 | Taveroff | 206/581 |
| 5,775,499 | 7/1998 | Budert . | |
| 5,829,590 | 11/1998 | Klein . | |
| 5,878,757 | 3/1999 | Hernandez | 206/349 |

*Primary Examiner*—Paul T. Sewell
*Assistant Examiner*—Luan K. Bui
*Attorney, Agent, or Firm*—Grace J. Fishel

[57] ABSTRACT

A collapsible curling iron organizer with a box, lid and a tray. The tray has holes with sleeves within which a heated end of a curling iron may be received and suspended from the tray. The lid has a stop for holding the tray at an incline, with the curling irons in a first orderly and compact arrangement, when the organizer is in use by a hair stylist. The tray has an aperture through which a compartment in the box can be reached for storing the curling irons in a second orderly and compact arrangement when the organizer is collapsed for travel.

10 Claims, 3 Drawing Sheets

COLLAPSIBLE CURLING IRON ORGANIZER

BACKGROUND OF THE INVENTION

1. Field of the Invention

The present invention relates generally to a collapsible curling iron organizer designed to accommodate a plurality of curling irons in orderly arrangement allowing facilitated use and carriage thereof.

2. Brief Description of the Prior Art

Curling irons have been used for years to administer heat to strands of hair which are held in a curled position, thus providing a wave or curl when the hair is returned to its normal temperature. There are thermal curling irons that are heated in an oven and electrically heated curling irons that have a cord attached. In order to achieve curls of various sizes it is necessary to use a number of differently-sized curling irons about which the hair is wrapped and held in position during the heating process.

A beginning hair stylist will typically have at least three differently-sized curling irons and a professional stylist may have many more. The curling irons, like hair cutting scissors and other equipment, typically belong to the stylist. Some cosmetology schools issue a cosmetologist box into which most students drop the irons, wrapped in a towel to keep them together, along with combs, brushes, and other equipment. This tumble of things is a mess.

Professional hair stylists do salon and classroom demonstrations and platform artists do demonstrations at workshops and expos to which functions the stylist brings his or her set of curling irons. Other professional stylists travel to clients, such as celebrities, who prefer convenience and privacy and can afford the service, or to those clients who are confined to home or the like.

In the past, there have been "jewelry roll" style carriers for thermal curling irons that allow a professional stylist to carry his or her set of irons for use outside of a shop but these carriers do not facilitate use of the irons. There are also units that are designed to sit on a stylist's table in a shop that facilitate use, but that do not fold up for transport. It is these shortcomings which have prompted the present invention.

BRIEF SUMMARY OF THE INVENTION

Accordingly, the foremost objective of the present invention is the provision of a collapsible curling iron organizer that holds a set of curling irons in a first orderly and compact arrangement, with each curling iron held in a position from which it is readily accessible when the organizer is open in use. It is a further objective to provide an organizer that folds closed such that it can be readily carried while maintaining the irons in a second orderly and compact arrangement. Other objects and features of the invention will be in part apparent and in part pointed out hereinafter.

In accordance with the invention, a collapsible curling iron organizer is provided for use in keeping a plurality of curling irons in a first orderly and compact arrangement when the organizer is open in use and in a second arrangement when the organizer is collapsed for transport. The organizer has a box with a bottom, a pair of opposing sidewalls and a pair of opposing end walls. A lid is hinged at a top of a first one of the end walls and a tray is hinged at a top of a second one of the end walls. The tray is movable between a generally horizontal position and an inclined position. The lid has a stop on an underside for supporting the tray in the inclined position and the tray substantially spans the width and length of the box between the sidewalls and end walls when the tray is horizontal. The tray has a plurality of holes adjacent each sidewall with a heat resistant sleeve axially aligned with each hole within which a heated end of a curling iron may be received, the curling iron being suspended from the tray through the sleeve.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
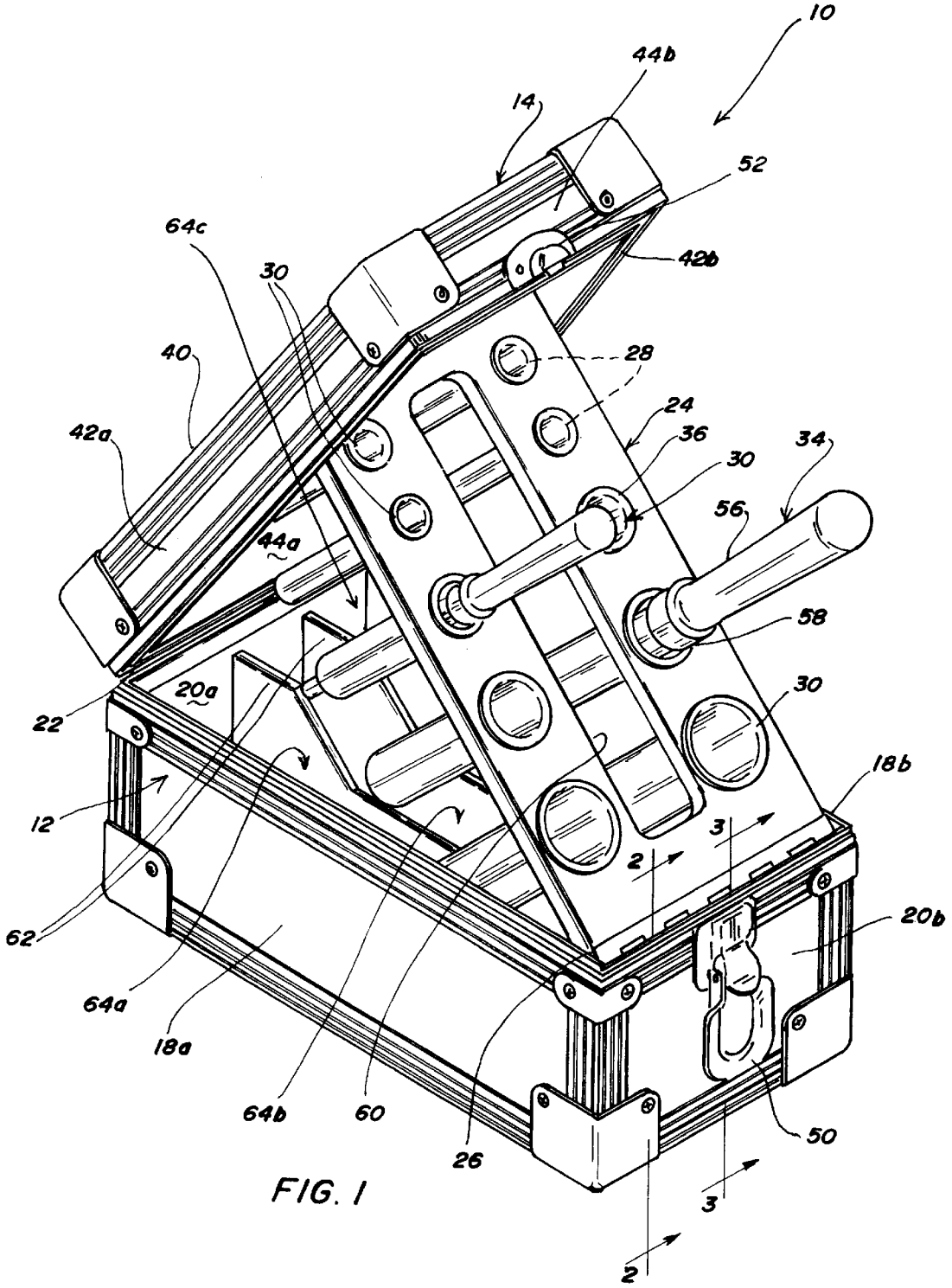
FIG. 1 is a perspective view of a collapsible curling iron organizer in accordance with the present invention shown open for use by a hair stylist.
Figure 2:
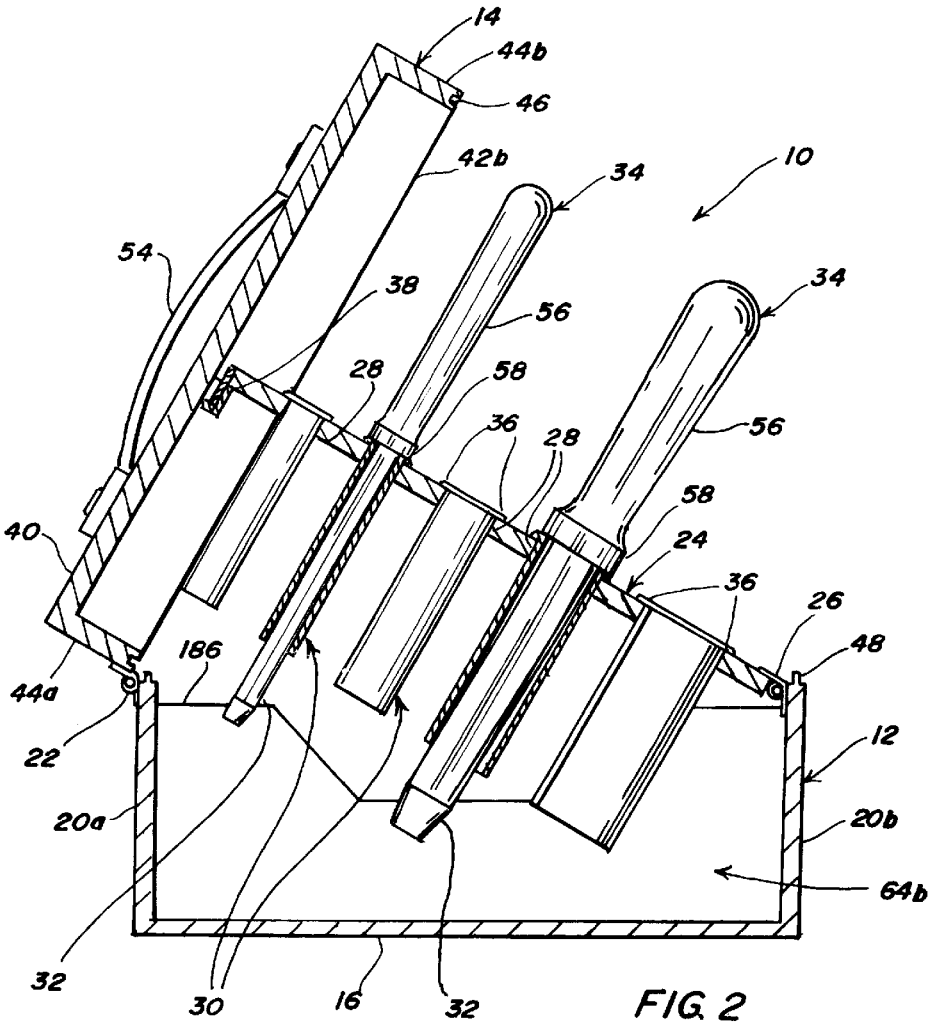
FIG. 2 is a sectional view taken along line 2—2 in FIG. 1.
Figure 3:
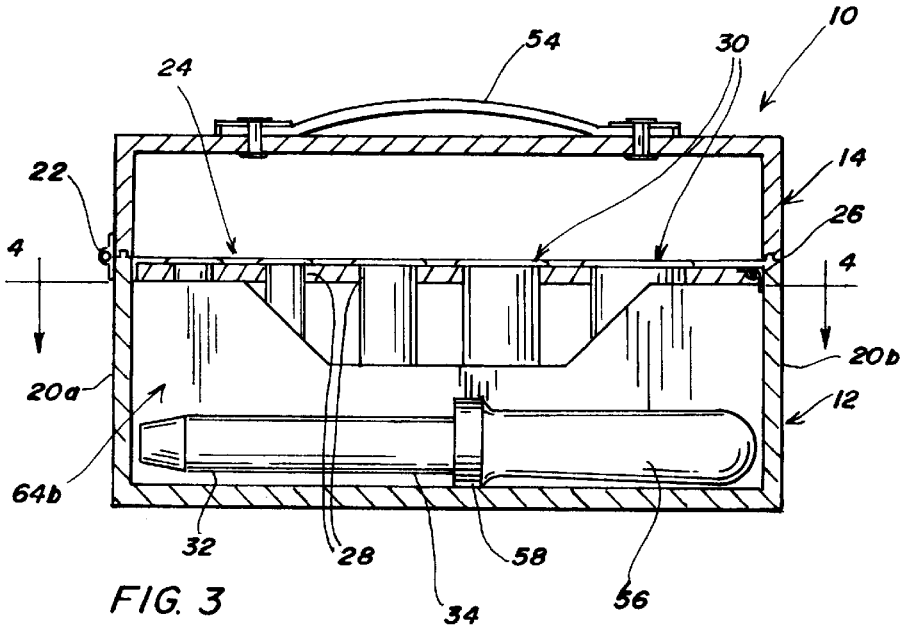
FIG. 3 is a sectional view taken along line 3—3 in FIG. 1.

Referring to the drawings more particularly by reference character, reference numeral 10 refers to a collapsible curling iron organizer in accordance with the present invention. Organizer 10 includes an open box 12 with a lid 14. Box 12 has a bottom 16, a pair of opposing sidewalls 18*a,* 18*b* and a pair of opposing end walls 20*a,* 20*b.* Lid 14 is hinged at 22 along a top edge of first end wall 20*a* and is movable between an open position as shown in FIGS. 1 and 2 and a closed position as shown in FIG. 3. A tray 24 is hinged at 26 along a top edge of second end wall 20*b* and is movable between a horizontal position, generally parallel to bottom 16, as shown in FIG. 3 and an inclined position as shown in FIGS. 1 and 2.

Tray 24 substantially spans the width and length of box 12 between sidewalls 18*a,* 18*b* and end walls 20*a,* 20*b,* respectively. Tray 24 has a plurality of holes 28 adjacent each sidewall with an open ended, heat resistant sleeve 30 axially aligned with each hole and within which a heated end 32 of a curling iron 34, as more particularly described below, may be received. Each of sleeves 30 depends from tray 24 by a flange 36. Holes 28 are preferably arranged in two parallel rows aligned with sidewalls 18*a,* 18*b* and sleeves 30 are preferably made from a heat resistant plastic or from a metal, such as steel or aluminum. Metal is preferred to reduce deterioration due to the elevated temperatures of heated end 32 of curling iron 34 and also to provide a smooth sliding surface to minimize wear on irons 34 placed therein. While organizer 10 is illustrated with two rows of holes 28, it will be appreciated that a different organizer 10 with more holes, or more rows, is within the scope of the present invention.

A stop 38 (FIG. 2) is provided on the underside of lid 14 for supporting tray 24 in an inclined position as shown in FIGS. 1 and 2. Lid 14 may be a flat plate or take the form of a shallow open box with a top 40, a pair of opposing sidewalls 42*a,* 42*b* and a pair of opposing end walls 44*a,*

44*b*. Stop 38 may take the form of a rail, generally parallel with end walls 44*a*, 44*b*, upon which tray 24 may rest.

A rim of sidewalls 42*a*, 42*b* and end walls 44*a*, 44*b* of lid 14 may be grooved 46 (FIG. 2) for seated receipt on a lip 48 (FIG. 2) formed along a rim of box 12.

It is intended that box 12 and lid 14 be detachably held in closed position. Any suitable type of fastener may be employed for this purpose. In the illustrated embodiment one snap fastener is employed. A first element 50 is mounted on an outer side of end wall 20*b* of box 12 and a second element 52 is mounted on an outer side of end wall 44*b* of lid 14. Provision may also be made for locking the organizer in a closed position, for which purpose, any suitable type lock may be employed. It may also be noted at this point that box 12, lid 14 and tray 24 may be made of any suitable material such as plastic, metal or wood. Plastic is preferred, although this is especially noted as not being a limitation of the invention.

A strap handle 54 or the like may be provided on the outside of lid top 40 for use in carrying organizer 10 when it has been collapsed for transport. Alternatively, as will occur to those skilled in the art, handholds (not shown) may be provided in sidewalls 18*a*, 18*b* or end walls 20*a*, 20*b* of box 12 for use in carrying organizer 10.

Curling irons 34 may be of the kind thermally heated in an oven so as to be completely separate and independent of any heating elements during the curling operation. Curling irons 34 may also be of the kind with a cord and electrically heated. Heated end 32 of iron 34 is connected to a handle 56, the forward end of which is enlarged to provide an enlarged annular boss 58 serving as a clear definition between the forward boundary of handle 56 and heated end 32 as well as to protect a user's hand from undesirable contact with heated end 32.

Sleeves 30 have an inside diameter such that when heated end 32 of curling iron 34 is inserted through the sleeve, the iron hangs on boss 58 from flange 36. Sleeves 30 may be provided in different sizes, with different inside diameters as shown in the drawings, or may be all of one size as handles 56 of differently-sized curling irons 34 may not vary in size, even though heated ends 32 differ in diameter. Hence differently-sized curling irons 34 will hang by their handles from flange 36 of similarly-sized sleeves 30.

Figure 4:
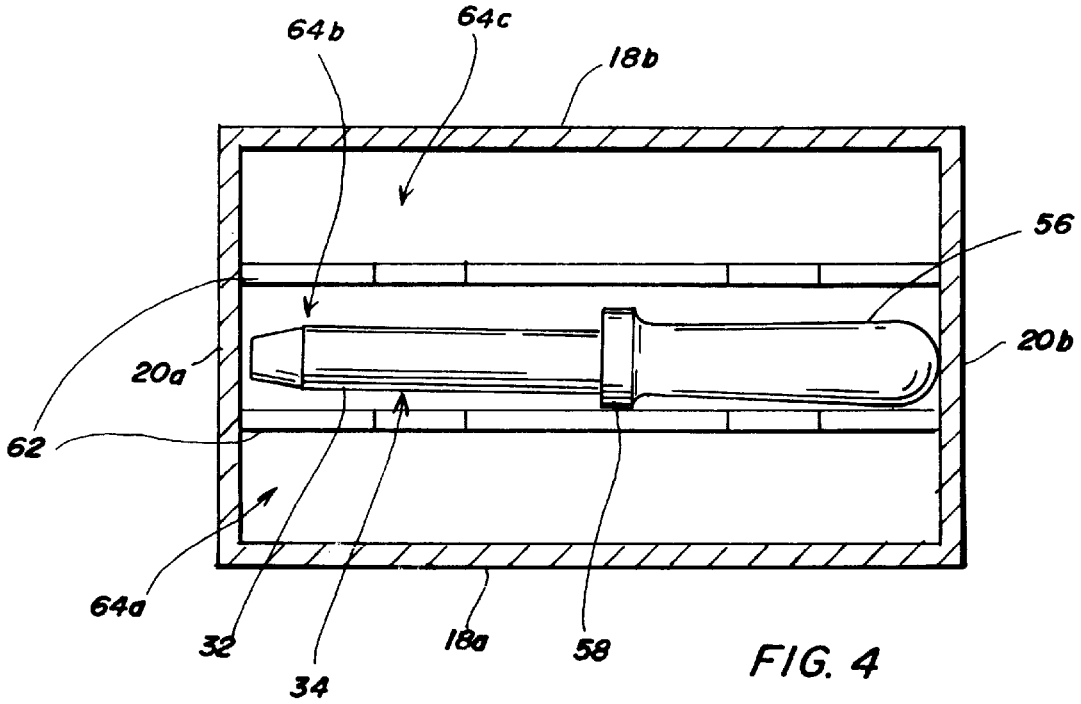
FIG. 4 is a sectional view taken along line 4—4 in FIG. 3.
Figure 5:
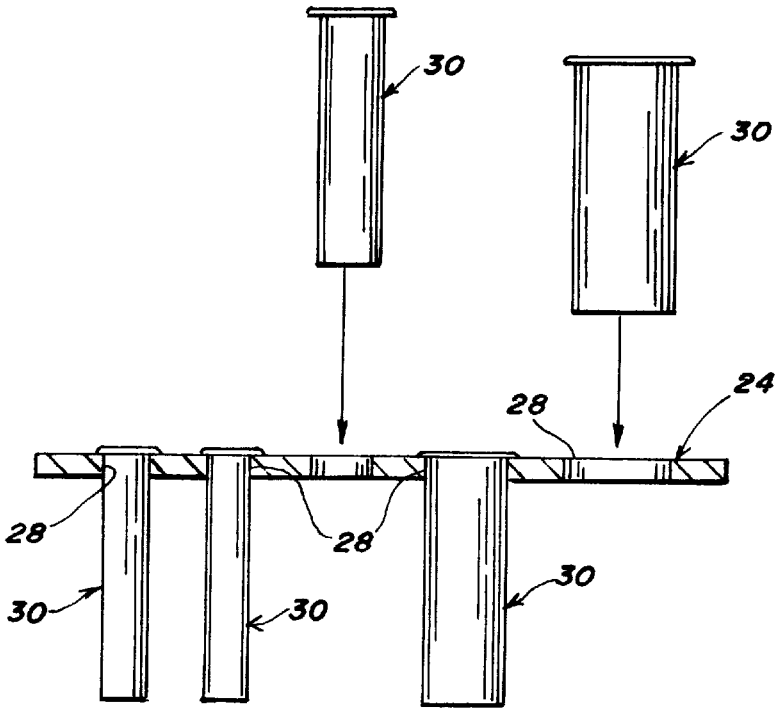
FIG. 5 is a detail, partially exploded, showing the tray in cross-section and associated sleeves in side elevation.

An elongated aperture 60 is provided in tray 24, flanked by holes 28. A pair of spaced panels 62 may divide box 12 into three compartments 64*a*, 64*b* and 64*c*. Compartments 64*a* and 64*c* receive sleeves 30 when organizer 10 is collapsed into closed position, while compartment 64*b*, under aperture 60, holds curling irons 34, a representative one of which is shown in FIGS. 3 and 4, when the organizer is ready for transport.

In use, organizer 10 is carried by handle 54 and sat upon a support surface for use by a hair stylist. Fasteners 50, 52 are unsnapped, lid 14 pivoted open and tray 24 moved into inclined position, resting on stop 38 on the underside of lid 14. Curling irons 34, held in an orderly and compact arrangement, may be removed from compartment 64*b* through aperture 60 and inserted into a selected sleeve 30. It will be appreciated that curling irons 34 will naturally slip by gravity in sleeves 30 with little or no effort where they are held in an orderly and compact arrangement. Moreover, by tray 24 making an angle with respect to support surface upon which organizer 10 is placed, handles 56 of irons 34 are in an optimum position to be withdrawn from sleeves 30 when needed for use, thus allowing the hair stylist to concentrate on the primary job of curling hair. Sleeves 30 keep heated ends 32 of curling irons 34 from swinging and becoming entangled even if organizer 10 is jostled.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A collapsible curling iron organizer comprising an open box with a bottom, a pair of opposing sidewalls and a pair of opposing end walls, a lid hinged at a top of a first of the end walls and a tray hinged at a top of a second of the end walls, said lid movable between an open and closed position and said tray movable between a substantially horizontal position and an inclined position, said tray substantially spanning the width and length of the box between the sidewalls and end walls, respectively, said tray having a row of holes adjacent each sidewall with a heat resistant sleeve axially aligned with each hole within which a heated end of a curling iron may be received with the curling iron being suspended from the tray through the sleeve.

2. The organizer according to claim 1 wherein the tray has an elongated slot flanked by the holes.

3. The organizer according to claim 2 wherein the box is divided by a pair of spaced panels into three compartments, one of said compartments being under the aperture and the other of the compartments being under the rows of holes adjacent the sidewalls.

4. A collapsible curling iron organizer comprising an open box with a bottom, a pair of opposing sidewalls and a pair of opposing end walls, a lid hinged at a top of a first of the end walls and a tray hinged at a top of a second of the end walls, said lid movable between an open and closed position and said tray movable between a substantially horizontal position and an inclined position, said lid having a stop on an underside for supporting the tray in the inclined position, said tray substantially spanning the width and length of the box between the sidewalls and end walls, respectively, said tray having a row of holes adjacent each sidewall with a heat resistant sleeve axially aligned with each hole within which a heated end of a curling iron may be received with the curling iron being suspended from the tray through the sleeve.

5. The organizer according to claim 4 wherein the tray has an elongated slot flanked by similarly-sized holes.

6. The organizer according to claim 5 wherein the box is divided by a pair of spaced panels into three compartments, one of said compartments being under the aperture and the other of the compartments being under the rows of holes adjacent the sidewalls.

7. The organizer of claim 6 with a fastener for holding the box and lid in closed position.

8. The organizer of claim 7 wherein the fastener has a lock.

9. The organizer of claim 4 wherein a handle is provided on the outside of the lid for carrying the organizer in collapsed condition.

10. The organizer of claim 4 wherein the box, the lid and the tray are formed of a heat resistant plastic and the sleeve is formed of metal.

* * * * *